US007942123B2

(12) United States Patent
Hara et al.

(10) Patent No.: US 7,942,123 B2
(45) Date of Patent: May 17, 2011

(54) VARIABLE VALVE SYSTEM FOR INTERNAL COMBUSTION ENGINE

(75) Inventors: Seinosuke Hara, Atsugi (JP); Makoto Nakamura, Isehara (JP)

(73) Assignee: Hitachi, Ltd., Tokyo (JP)

( * ) Notice: Subject to any disclaimer, the term of this patent is extended or adjusted under 35 U.S.C. 154(b) by 330 days.

(21) Appl. No.: 12/266,165

(22) Filed: Nov. 6, 2008

(65) Prior Publication Data

US 2009/0120393 A1 May 14, 2009

(30) Foreign Application Priority Data

Nov. 13, 2007 (JP) ..... 2007-294374

(51) Int. Cl.
*F01L 1/18* (2006.01)

(52) U.S. Cl. ..... 123/90.39; 123/90.16; 123/90.44; 74/559; 74/569

(58) Field of Classification Search ..... 123/90.16, 123/90.39, 90.44; 74/559, 567, 569
See application file for complete search history.

(56) References Cited

U.S. PATENT DOCUMENTS 7,669,564 B2 * 3/2010 Tochiki et al. ..... 123/90.16

FOREIGN PATENT DOCUMENTS

JP 11-107725 A 4/1999
JP 11-264307 A 9/1999

* cited by examiner

*Primary Examiner* — Ching Chang
(74) *Attorney, Agent, or Firm* — Foley & Lardner LLP

(57) ABSTRACT

A variable valve system has a drive shaft having a drive cam, a rockable cam opening/closing an engine valve, a transmission mechanism converting torque of the drive cam into a rocking motion and transmitting it to the rockable cam, a control shaft, and a control cam. When the variable valve system varies a valve lift amount of the engine valve by changing the rocking fulcrum of the transmission mechanism, the rocking fulcrum during a small valve lift control is set in an area outside an arc locus drawn with the drive shaft being a center of the arc and passing through a rocking fulcrum position positioned at a maximum valve lift and also inside an arc locus drawn with a pivot of the one end side of the transmission mechanism being a center of the arc and passing through the rocking fulcrum position positioned at the maximum valve lift.

7 Claims, 12 Drawing Sheets

VARIABLE VALVE SYSTEM FOR INTERNAL COMBUSTION ENGINE

BACKGROUND OF THE INVENTION

The present invention relates to a variable valve system for an internal combustion engine, which is capable of varying and adjusting at least a valve lift amount of an engine intake valve or an engine exhaust valve in accordance with an engine operating state.

In recent years, there have been proposed and developed various variable valve systems, which control valve open and closure timings and a valve lift amount of engine intake/exhaust valves in accordance with an engine operating state in order to ensure an improvement of fuel efficiency and a stable drivability during an engine low-speed (low-revs) and low-load operation and to ensure a sufficient output by an increase of an intake air charging efficiency during an engine high-speed (high-revs) and high-load operation. One such variable valve system has been disclosed in Japanese Patent Provisional Publication No. 11-264307 (FIGS. 9 and 10) (hereinafter is referred to as "JP11-264307") which was previously applied by the same applicants of this application.

Brief explanation of JP11-264307 will be made below. The variable valve system in JP11-264307 has a drive cam integrally formed with an outer circumference of a drive shaft that rotates by a crank shaft, a multi-link type transmission mechanism formed from a rocker arm that converts a turning force or torque of the drive cam into a rocking motion and a link member etc., a rockable cam that operates open/close function of an intake valve by its sliding motion on an upper surface of a valve lifter through the transmission mechanism, a support arm which is laying almost sideways and whose base end portion is rotatably supported by the drive shaft and whose top end portion is rotatably supported by a rocking fulcrum of the rocker arm of the transmission mechanism, a drive mechanism which revolves the top end side of the support arm in an up-and-down direction then inclines the support arm within a predetermined range, and a controller that controls a forward/reverse rotation of the drive mechanism in accordance with the engine operating state.

By controlling the revolution of the support arm in the up-and-down direction through the drive mechanism, a sliding position of the rockable cam on the upper surface of the valve lifter is changed via the rocker arm of the transmission mechanism and the link member, the lift amount of the intake valve is then controlled.

SUMMARY OF THE INVENTION

In the variable valve system in JP11-264307, however, as described above, by revolving (or inclining) the support arm in the up-and-down direction, the valve lift amount of the intake valve is controlled through the change of the sliding position of the rockable cam on the upper surface of the valve lifter. For this reason, for instance, in a case where a rotation direction of the drive shaft and a rocking direction at a time of a valve-open lift by the rockable cam are the same, as shown in FIG. 10 in JP11-264307, while a variation of phase of start of the intake valve open timing at a time of a control change of the valve lift amount of the intake valve from a large valve lift amount to a small valve lift amount is extremely small, the phase variation of the valve closure timing is large.

That is, when changing a valve lift range from a large valve lift range to a small valve lift range, although the support arm is revolved in the upward direction by the drive mechanism first then the rocker arm is also moved in the upward direction together with the revolution of the support arm, since the drive cam rotates in a direction opposite to this direction, a rocking timing of the rocker arm is temporarily advanced. This results in an excessively advanced timing of valve open timing IVO (intake valve open timing) in a lift characteristic of the intake valve, then the phase variation of the valve open timing at the lift change is extremely small.

Consequently, in a case where the valve lift amount is controlled from the large lift to the small lift at the low-speed and low-load operation, its valve overlap amount becomes almost the same as a valve overlap with an exhaust valve under the large valve lift control. Then this causes an increase of a residual gas and a deterioration of combustion at the low-speed and low-load operation, and the fuel efficiency may become worse. That is to say, the valve overlap amount according to the engine operating or running state cannot be properly controlled in the variable valve system in JP11-264307.

It is therefore an object of the present invention to provide a variable valve system which is capable of solving technical problems of the conventional variable valve system.

According to one aspect of the present invention, a variable valve system of an internal combustion engine, comprises: a drive shaft which has a drive cam on an outer periphery thereof and to which a power is transmitted from an engine crankshaft; a rockable cam which is rockably supported and opens/closes an engine valve; a transmission mechanism, one end side of which is rotatably linked to the drive cam through a pivot and the other end side of which is linked to the rockable cam, the transmission mechanism converting a torque of the drive cam into a rocking motion and transmitting the rocking motion to the rockable cam; a control shaft, a rotation of which is controlled by an actuator; and a control cam which is fixed on an outer periphery of the control shaft and is a rocking fulcrum of the transmission mechanism, a shaft center of the control cam deviating from a shaft center of the control shaft, and the variable valve system varying a valve lift amount of the engine valve by changing the rocking fulcrum of the transmission mechanism through a rotation control of the control cam via the control shaft, and the rocking fulcrum of the transmission mechanism during a small valve lift control of the engine valve is positioned in an area outside an arc locus which is drawn with the drive shaft being a center of the arc and passes through a rocking fulcrum position positioned at a time of a maximum valve lift and also inside an arc locus which is drawn with a pivot of the one end side of the transmission mechanism being a center of the arc and passes through the rocking fulcrum position positioned at the time of the maximum valve lift.

According to another aspect of the present invention, a variable valve system of an internal combustion engine, comprises: a drive shaft which has a drive cam on an outer periphery thereof and to which a power is transmitted from an engine crankshaft; a rockable cam which is rockably supported and opens/closes an engine valve; a control shaft, a rotation of which is controlled by an actuator; a control cam which is fixed on an outer periphery of the control shaft, a shaft center of the control cam deviating from a shaft center of the control shaft; and a rocker arm, one end side of which is rotatably fitted onto an outer periphery of the control cam and is a rocking fulcrum, a substantially central portion of which is linked to the drive cam through a link arm, and the other end side of which is linked to the rockable cam through a link rod, the rocker arm converting a torque of the drive cam into a rocking motion and transmitting the rocking motion to the rockable cam, and the variable valve system varying a valve lift amount of the engine valve by changing the rocking fulcrum of the rocker arm through a rotation control of the control cam via the control shaft, and the rocking fulcrum of the rocker arm during a small valve lift control of the engine valve is positioned in an area inside an arc locus which is drawn with the drive shaft being a center of the arc and passes through a rocking fulcrum position positioned at a time of a maximum valve lift and also outside an arc locus which is drawn with a pivot of the rocker arm and the link arm being a center of the arc and passes through the rocking fulcrum position positioned at the time of the maximum valve lift.

According to a further aspect of the invention, a variable valve system of an internal combustion engine, comprises: a drive shaft which has a drive cam on an outer periphery thereof and to which a power is transmitted from an engine crankshaft; a rockable cam which is rockably supported and opens an engine valve by a pull-up movement of one end side of the rockable cam; a rocker arm, one end side of which is rotatably linked to the drive cam and the other end side of which is linked to the rockable cam, the rocker arm converting a torque of the drive cam into a rocking motion and transmitting the rocking motion to the rockable cam; a control shaft, a rotation of which is controlled by an actuator; and a control cam which is fixed on an outer periphery of the control shaft and is a rocking fulcrum of the rocker arm, a shaft center of the control cam deviating from a shaft center of the control shaft, and the variable valve system varying a valve lift amount of the engine valve by changing the rocking fulcrum of the rocker arm through a rotation control of the control cam via the control shaft, and the rocking fulcrum of the rocker arm during a small valve lift control of the engine valve is positioned in an area outside an arc locus which is drawn with the drive shaft being a center of the arc and passes through a rocking fulcrum position positioned at a time of a maximum valve lift and also inside an arc locus which is drawn with a pivot of the rocker arm and the link arm being a center of the arc and passes through the rocking fulcrum position positioned at the time of the maximum valve lift.

According to a still further aspect of the invention, a variable valve system of an internal combustion engine, comprises: a drive shaft which has a drive cam on an outer periphery thereof and to which a power is transmitted from an engine crankshaft; a rockable cam which is rockably supported and opens an engine valve by a pull-up movement of one end side of the rockable cam; a transmission mechanism, one end side of which is rotatably linked to the drive cam through a pivot and the other end side of which is linked to the rockable cam, the transmission mechanism converting a torque of the drive cam into a rocking motion and transmitting the rocking motion to the rockable cam; a control shaft, a rotation of which is controlled by an actuator; and a control cam which is fixed on an outer periphery of the control shaft and is a rocking fulcrum of the transmission mechanism, a shaft center of the control cam deviating from a shaft center of the control shaft, and the variable valve system varying a valve lift amount of the engine valve by changing the rocking fulcrum of the transmission mechanism through a rotation control of the control cam via the control shaft, and the rocking fulcrum of the transmission mechanism during a small valve lift control of the engine valve is positioned in an area inside an arc locus which is drawn with the drive shaft being a center of the arc and passes through a rocking fulcrum position positioned at a time of a maximum valve lift and also outside an arc locus which is drawn with a pivot of the one end side of the transmission mechanism being a center of the arc and passes through the rocking fulcrum position positioned at the time of the maximum valve lift.

In the present invention, when controlling the valve lift amount of the intake valve from the large valve lift amount to the small lift amount, since the rocking fulcrum of the transmission mechanism is changed while moving within the area defined by the each arc locus, the phase variation of the valve open timing of the intake valve can be relatively small and also the phase variation of the valve closure timing can be great. That is, during the small valve lift control, while a center angle phase of the lift is being controlled to an advanced angle side as compared with that of a case of a maximum valve lift, an amount of an advanced angle of the valve open timing can be controlled, for example, to a slightly retarded position as compared with a position of a substantially top dead center (TDC) of a piston. Therefore, it is possible to properly control the valve overlap with the exhaust valve during the small valve lift control of the engine valve.

The other objects and features of this invention will become understood from the following description with reference to the accompanying drawings.

BRIEF DESCRIPTION OF THE DRAWINGS

FIG. 6A is a valve open state, FIG. 6B is a valve closure state.

FIG. 7A is a valve open state, FIG. 7B is a valve closure state.

DETAILED DESCRIPTION OF THE INVENTION

Embodiments of a variable valve system for an internal combustion engine will be explained below with reference to the drawings. The embodiments show a case where the variable valve system is applied to an engine intake side of the combustion engine.

First Embodiment

Figure 1:
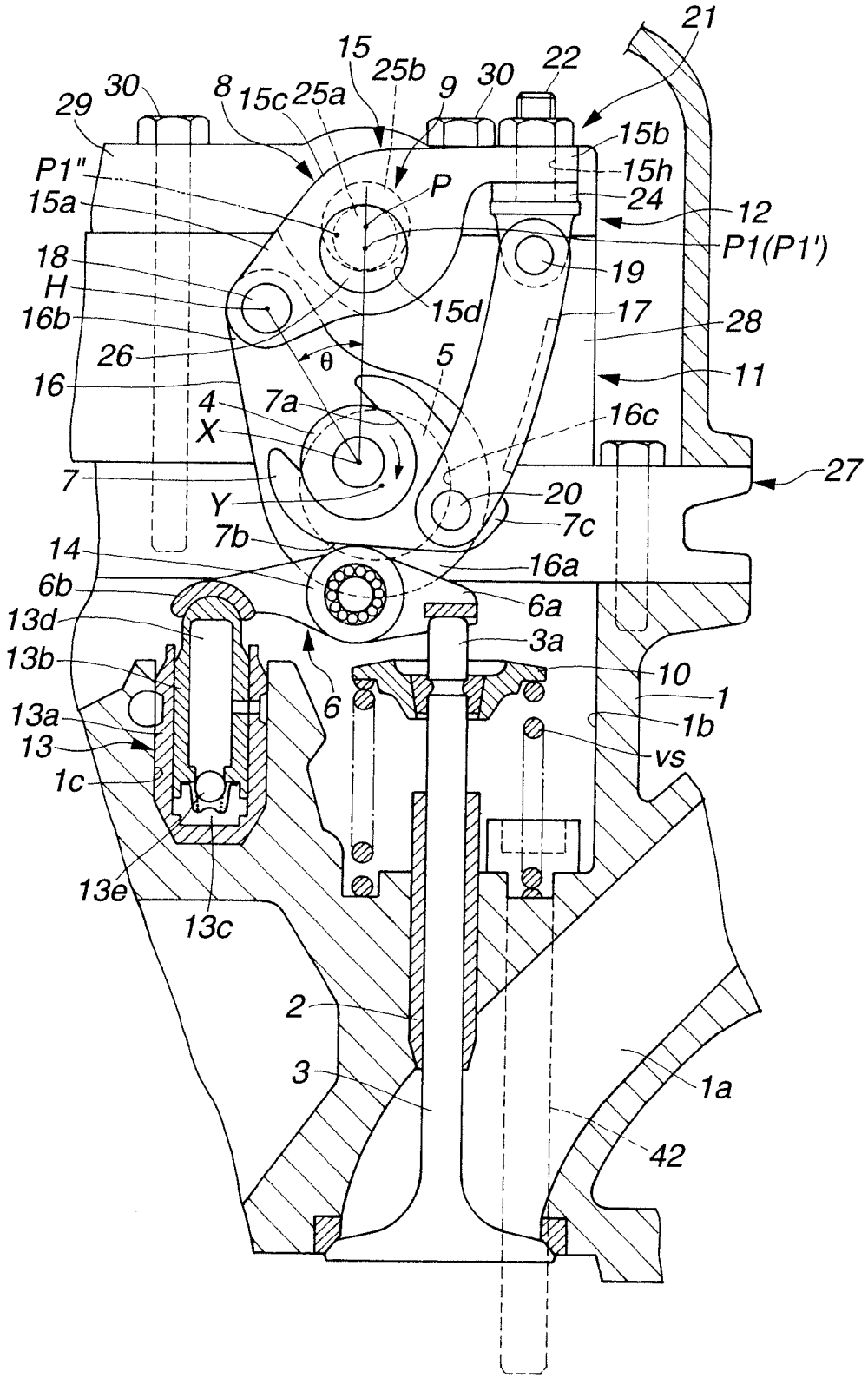
FIG. 1 is a sectional view of an essential part of a variable valve system of a first embodiment.
Figure 2:
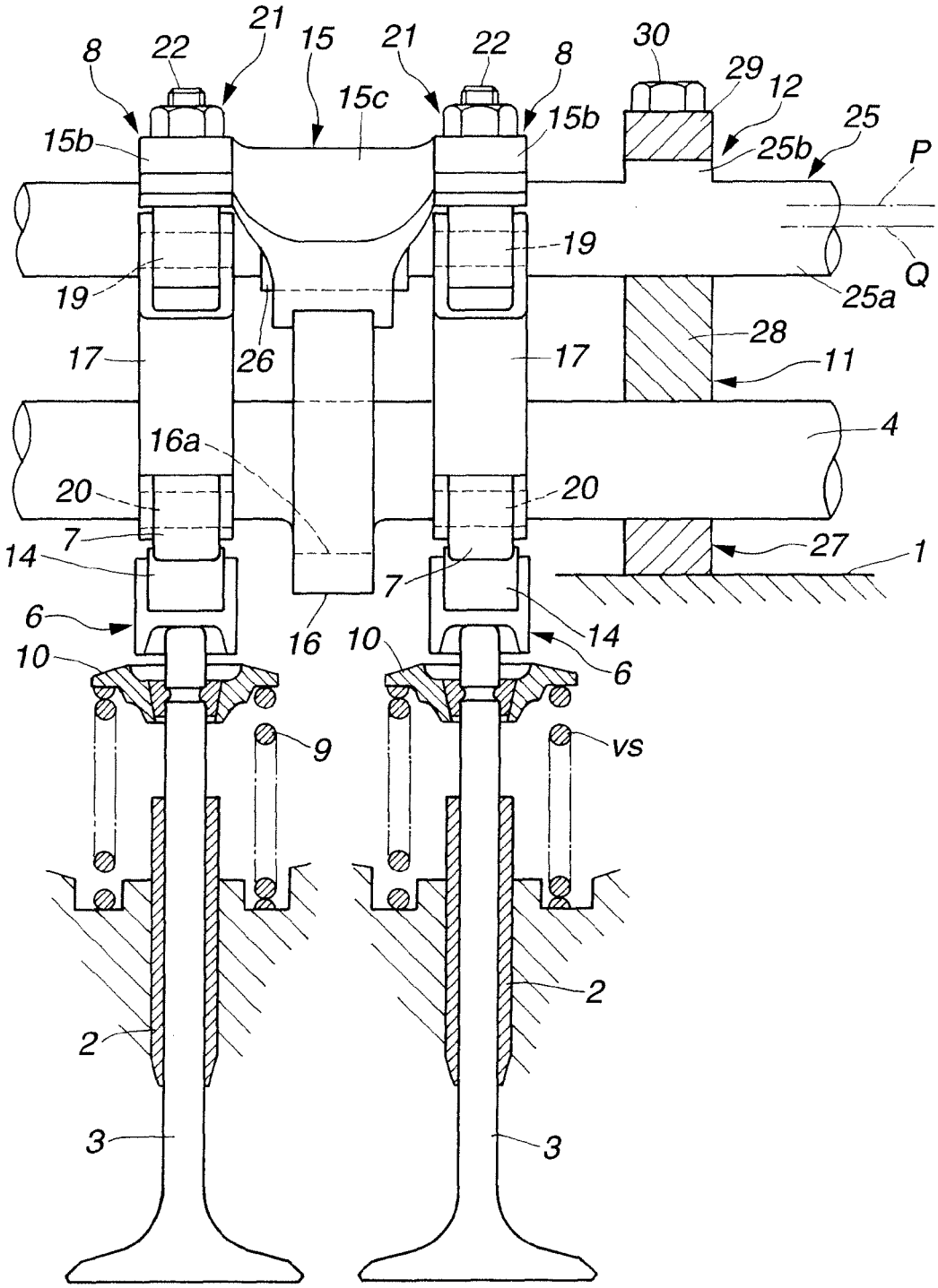
FIG. 2 is a front view of the essential part of the variable valve system.
Figure 3:
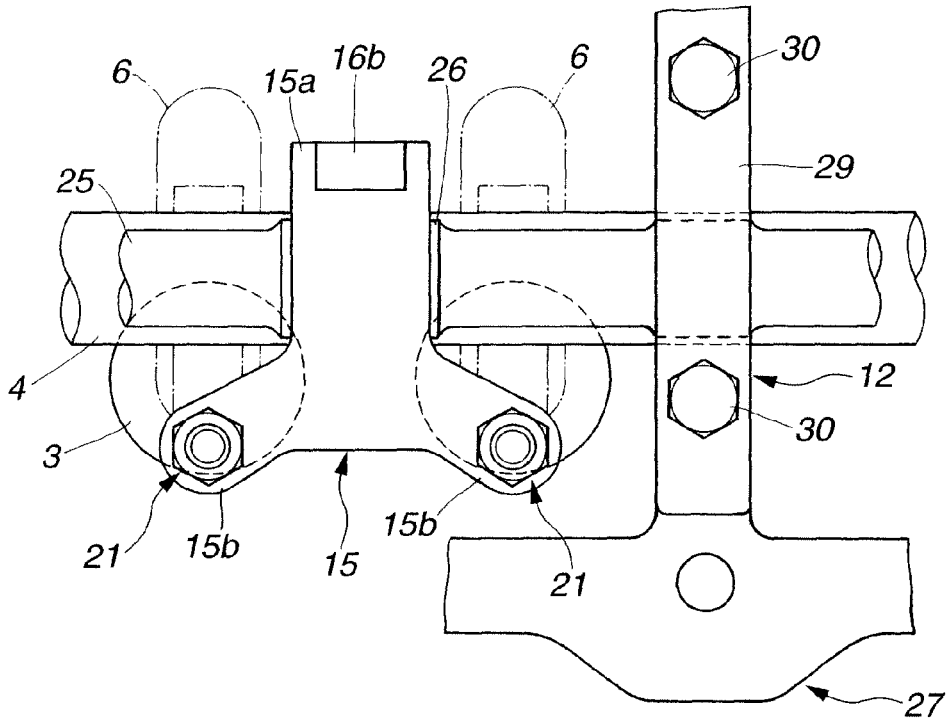
FIG. 3 is a plan view of the essential part of the variable valve system.

As illustrated in FIGS. 1 to 3, a variable valve system of a first embodiment has two intake valves 3, 3 per cylinder, each of which is slidably provided in a cylinder head 1 through a valve guide 2 and opens/closes an intake port 1*a*, a hollow drive shaft 4 that is disposed in a longitudinal direction of the engine, a drive cam 5 that is fixedly provided at the drive shaft 4 for each cylinder, swing arms 6, 6, each of which is a follower and is installed on a top end of the intake valve 3, a pair of rockable cams 7, 7 which operate an opening movement of the intake valves 3, 3 via the swing arms 6, 6, a transmission mechanism 8 which connects the drive cam 5 and the rockable cams 7, 7 and converts a turning (or rotation) force or torque of the drive cam 5 into a rocking motion then transmits it to the rockable cams 7, 7 as a rocking force (a valve opening force), and a control mechanism 9 which varies a rocking fulcrum of a rocker arm 15 (described later) of the transmission mechanism 8 and adjusts or controls a valve lift amount of the each intake valve 3 in accordance with an engine operating or running state.

As shown in FIGS. 1 and 2, valve springs vs, vs are respectively installed between a bottom of a substantially cylindrical bore 1*b* formed inside an upper portion of the cylinder head 1 and a spring retainer 10 positioned at an upper part of a valve stem, the intake valves 3, 3 are then forced in a direction that closes or covers each opening end of the intake ports 1*a*, 1*a* by the valve springs vs, vs.

Both ends of the drive shaft 4 are rotatably supported by an after-mentioned bearing portion 11 that is provided in the upper portion of the cylinder head 1. Torque is transmitted from an engine crankshaft (not shown) to the drive shaft 4 through a timing sprocket (not shown) provided at one axial end of the drive shaft 4 and a timing chain (also not shown), then the drive shaft 4 rotates in a clockwise direction (a direction indicated by an arrow) in FIG. 1.

Regarding the drive cam 5, as shown in FIGS. 1 and 2, it is substantially formed into a disk-shape and disposed between the rockable cams 7, 7. Further, a cam profile of an outer peripheral surface of the drive cam 5 is formed into an eccentric circle, and a shaft center Y of the drive cam 5 deviates from a shaft center X of the drive shaft 4 in a radial direction by a predetermined offset value. The drive cam 5 is fixedly connected with the drive shaft 4.

With respect to the swing arm 6, a lower surface of a recess-shaped one end 6*a* of the swing arm 6 is in contact with a stem end of the intake valve 3. On the other hand, a spherical lower surface of the other end 6*b* is in contact with and also is supported by a hydraulic lash adjuster 13 that is held inside a holding slot 1*c* formed in the cylinder head 1. The swing arm 6 swings or rocks with the hydraulic lash adjuster 13 being a pivot. Further, a needle roller 14 is rotatably supported by the swing arm 6 at a central hollow portion of the swing arm 6, and the each rockable cam 7 is in contact with the needle roller 14.

The hydraulic lash adjuster 13 is a hydraulic lash adjuster that has a normal structure. The hydraulic lash adjuster 13 has a bottomed cylindrical shaped body 13*a* that is fixed inside the holding slot 1*c*, and a plunger 13*b* which is installed slidably in an upward direction inside the body 13*a* and whose spherical top end portion is in contact with the lower surface of the other end 6*b* of the swing arm 6. The hydraulic lash adjuster 13 serves to constantly keep a gap or space between the top end portion of the plunger 13*b* and the other end 6*b* of the swing arm 6 (between a cam surface 7*b* of the rockable cam 7 and the needle roller 14) at 0 (zero). More specifically, the hydraulic lash adjuster 13 further has a high-pressure chamber 13*c* that is defined by the an inner bottom of the body 13*a* and a division of the plunger 13*b*, a reservoir 13*d*, and a pressure check valve 13*e*. By supplying a hydraulic pressure to the high-pressure chamber 13*c* properly or continually through the pressure check valve 13*e* in the reservoir 13*d*, the gap can be constantly kept at 0.

The rockable cam 7 is substantially formed into a raindrop shape as shown in FIG. 1, and the both rockable cams 7, 7 have the same shape. The rockable cam 7 has an almost U-shaped fitting gulf or hole 7*a* that is fitted onto an outer peripheral surface of the drive shaft 4 on a base end side of the rockable cam 7, and the rockable cam 7 is rockably or revolvably supported by the drive shaft 4 through the fitting hole 7*a* with the shaft center X of the drive shaft 4 being a center of the rocking or oscillating or revolving motion of the rockable cam 7. Further, the rockable cam 7 has the cam surface 7*b* at lower surface of the rockable cam 7. More specifically, the cam surface 7*b* is formed by a base-circle surface on the base end side, a circular-arc shaped ramp surface that extends from the base-circle surface toward a cam-nose portion 7*c*, a top surface which is positioned at a top end side of the cam-nose portion 7*c* and provides a maximum valve lift (or a maximum valve lift amount), and a lift surface by which the ramp surface and the top surface are joined. The rockable cam 7 is in contact with the an outer peripheral surface of the needle roller 14 of the swing arm 6 at these base-circle surface, ramp surface, lift surface and top surface depending on a rocking or oscillating position of the rockable cam 7 while the position of the outer peripheral surface of the needle roller 14 (or the swing arm 6) is moving in the up-and-down direction.

The each rockable cam 7 is set so that its rocking or oscillating direction that opens the each intake valve 3 by a shift of the contact of the cam surface 7*b* and the needle roller 14 to the lift surface side is the same as a rotation direction of the drive shaft 4.

In addition, as can be seen in FIGS. 1 and 2, the rockable cam 7 is provided with a pin insertion hole at the side of the cam-nose portion 7*c*, and the rockable cam 7 is linked with the other end portion of a link rod 17 (described later) through an insertion of a pin 20.

With regard to the transmission mechanism 8, as illustrated in FIG. 1, it has the rocker arm 15 disposed along an engine-width direction above the drive shaft 4, a link arm 16 that connects one end portion 15*a* of the rocker arm 15 and the drive cam 5, and a pair of link rods 17, 17, each of which connects one of two-divided other end portions 15*b*, 15*b* of the rocker arm 15 and the cam-nose portion 7*c* of the rockable cam 7.

As for the rocker arm 15, as shown in FIGS. 1 to 3, its plane shape is formed into Y-shape. The one end portion 15*a* that protrudes from a cylindrical base part 15*c* positioned at a middle of the rocker arm 15 toward the engine, is rotatably linked with a projecting or nose end 16*b* of the link arm 16 with a pin 18. On the other hand, the each of the two-divided other end portions 15*b*, 15*b* of the rocker arm 15 is rotatably linked to one end portion of the link rod 17 with a pin 19. Furthermore, the rocker arm 15 is provided with a support hole 15*d* at an inside of the cylindrical base part 15*c* for being fitted to and supported by an outer periphery or circumference of an after-mentioned control cam 26 with an infinitesimal gap or clearance.

The link arm 16 has a relatively large diameter annular ring portion 16*a* and the nose end 16*b* protruding from a certain position of an outer peripheral or circumference of the annular ring portion 16*a*, and is provided with a fitting hole 16*c* for rotatably supporting the outer peripheral surface of the drive cam 5 at a middle of the annular ring portion 16*a*.

The link rod 17 is formed as a single-piece rod by press working, and its cross section is formed into a shape of square bracket ("[") (or a shape of Japanese character "コ"). For miniaturization, an inner side of the link rod 17 is curved to a substantially arc shape, and the other end portion of the link rod 17 is rotatably linked with the cam-nose portion 7*c* of the rockable cam 7 with the pin 20.

In order to prevent the each pin 19 and 20 from coming out of the pin hole at connecting parts of the other end portion 15*b* of the rocker arm 15 and the one end portion of the link rod 17 and also the cam-nose portion 7*c* of the rockable cam 7 and the other end portion of the link rod 17, both ends of the pin 19 and 20 are riveted or caulked.

As shown in FIGS. 1 and 2, a lift adjustment or control mechanism 21 is provided between the one end portion of the each link rod 17 and the other end portion 15*b* of the each rocker arm 15.

The lift adjustment mechanism 21 has an adjusting bolt 22 whose head 22*a* is connected with the pin 19 of the one end portion of the link rod 17 while penetrating a bolt insertion hole 15*h*, a nut 23 that screws onto a top end portion of the adjusting bolt 22, a disk-shaped adjustment shim 24 that is inserted between a seat or bearing surface of the head 22*a* and a lower surface of the bolt insertion hole 15*h* of the other end portion 15*b*. Regarding this adjustment shim 24, a plurality of shims, each of which has a slightly different thickness, are previously prepared, and by selecting a proper shim, a fine-adjustment for the lift amount of the each intake valve 3 can be possible.

The control mechanism 9 has a control shaft 25 that is disposed parallel to the drive shaft 4 above the drive shaft 4, a control cam 26 which is integrally fixed to an outer periphery or circumference of the control shaft 25 and is a rocking or oscillating fulcrum of the rocker arm 15, and an actuator (not shown) for controlling a rotation of the control shaft 25.

Figure 4:
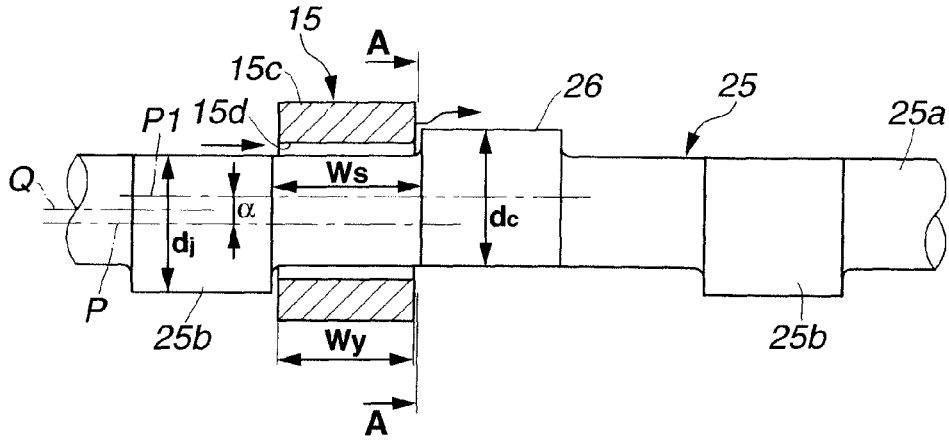
FIG. 4 is a side view showing part of a control shaft, a control cam and a rocker arm.
Figure 5:
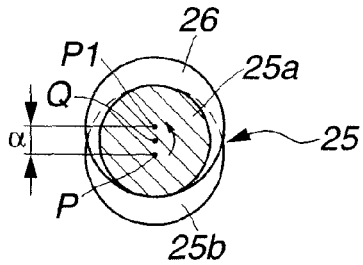
FIG. 5 is a sectional view, viewed from A-A of FIG. 4.

As illustrated in FIGS. 4 and 5, the control shaft 25 has a shaft body 25*a* that has a relatively small diameter, and a plurality of journal parts 25*b* which are integrally formed with an outer periphery or circumference of the control shaft 25 on a predetermined position in an axial direction. The each journal part 25*b* is rotatably supported by a second bearing portion 12 that is provided above the bearing portion 11. Further, an outside diameter dj of the journal part 25*b* is formed to be greater than the shaft body 25*a*, and a shaft center P of the journal part 25*b* deviates from a shaft center Q of the shaft body 25*a* in one direction. This large amount a of the eccentricity (eccentric amount a) is necessary to move or vary a rocking or oscillating center (fulcrum) of the rocker arm 15 large or widely to a predetermined position. However, in a case where this large variation or shift of the rocking center of the rocker arm 15 is obtained by only the eccentric amount of the journal part 25*b* with respect to the shaft body 25*a*, the control cam 26 becomes large and this results in large transmission mechanism 8. Thus, with the above linkage and structure, although a diameter of the control cam 26 is relatively small, the large eccentric amount can be obtained and also a compact transmission mechanism 8 is realized. Furthermore, if a lubricant passage is needed in the control shaft 25, since the control shaft 25 has a straight shape, the lubricant passage is easily formed and maintained when the control shaft 25 is formed by machining.

As for the control cam 26, it is formed into a cylindrical shape that is the same as the journal part 25*b*. An outside diameter dc of the control cam 26 is set to be slightly greater than the outside diameter dj of the journal part 25*b*. This outside diameter dc of the control cam 26 is set so that the control cam 26 can slide in the support hole 15*d* of the rocker arm 15 with the infinitesimal gap or clearance. Further, a shaft center P1 of the control cam 26 deviates from the shaft center P of the journal part 25*b* (also deviates from the shaft center Q of the shaft body 25*a*). More specifically, as shown in FIG. 4, the shaft center P1 of the control cam 26 is positioned on opposite side of the shaft center Q of the shaft body 25*a*, and opposite to the shaft center P of the journal part 25*b*. Therefore, the shaft center P1 of the control cam 26 deviates from the shaft center P of the journal part 25*b* by a large eccentric amount $\alpha$.

As can be seen in FIG. 4, a distance Ws between the journal part 25*b* and the control cam 26 is set to be greater than a width Wy of the cylindrical base part 15*c* of the rocker arm 15. Then when the rocker arm 15 is fitted onto the control cam 26, as shown by an arrow in FIG. 4, after inserting the cylindrical base part 15*c* onto an outer peripheral surface of the journal part 25*b* through the support hole 15*d*, the cylindrical base part 15*c* is moved in a radial direction then the support hole 15*d* is fitted onto the outer peripheral surface of the control cam 26. Thus, with these dimensions and structure, the setting or assembling of the rocker arm 15 can be easily performed.

Here, regarding the bearing portion 11, as illustrated in FIGS. 1 and 2, it has a supporting frame 27 that is installed and fixed to an upper surface of an upper deck of the cylinder head 1, and main brackets 28 that are fixed to an upper surface of the supporting frame 27 at regular intervals in the longitudinal direction of the engine. On the other hand, as for the second bearing portion 12, it has the each main bracket 28 and sub brackets 29, each of which is fixed to an upper surface of the main bracket 28. Both of these main bracket 28 and sub bracket 29 are secured to the supporting frame 27 while both parts of the brackets are overlapping, with a plurality of bearing bolts 30 which are inserted into the bolt insertion holes.

The actuator is formed by an electric motor that is mounted and fixed to a rear end portion of the cylinder head 1, and a speed reducer such as a ball screw mechanism, which transmits a rotation driving force of the electric motor to the control shaft 25.

The electric motor is a proportional DC motor, and is driven by a control signal from a controller (not shown) that detects the engine operating or running state. This controller receives detection signals from a crank angle sensor for detecting an engine speed, an airflow meter for detecting an intake air quantity, a water or coolant temperature sensor for detecting a water temperature of the engine, and a potentiometer for sensing a rotational position of the control shaft 25, and detects a current engine operating state then outputs the control signal to the electric motor.

In this embodiment, for example, during an engine low-speed (low-revs) and low-load operation, although the each intake valve 3 is controlled to a small valve lift, the shaft center Pt of the control cam 26 at this time is set within a specific area with a shaft center P1' at the maximum valve lift being the origin.

Figure 6A:
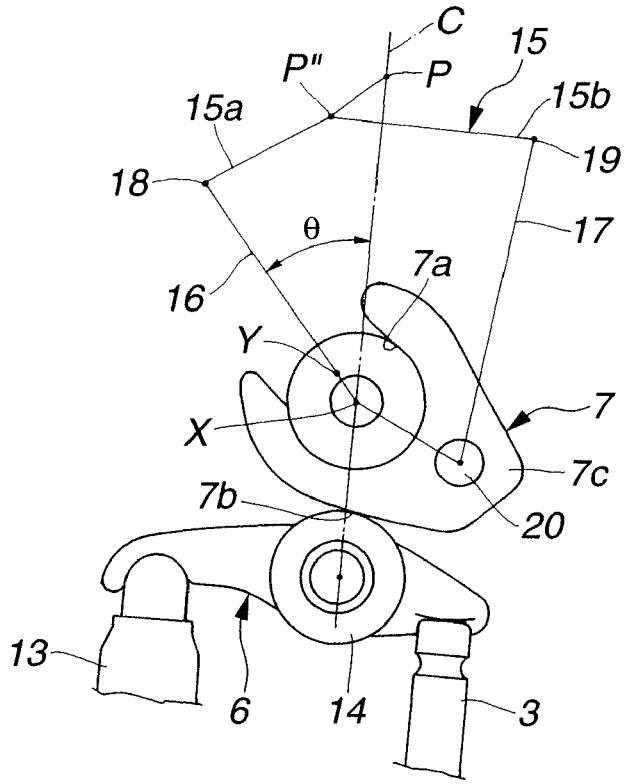
FIGS. 6A and 6B are schematic drawings for explanation of working at a small valve lift control.
Figure 7A:
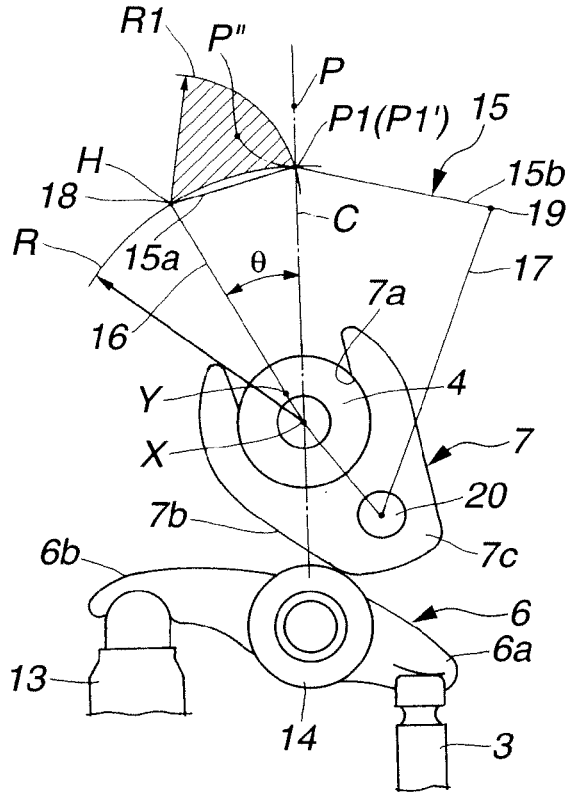
FIGS. 7A and 7B are schematic drawings for explanation of working at a maximum valve lift control.

That is, at the time of the small valve lift control of the intake valve 3, as shown in FIGS. 6A and 7A, the rocking fulcrum of the rocker arm 15, namely the shaft center P1 (P1") of the control cam 26, is set so that the shaft center P1 (P1") is positioned in an area outside an arc locus R which is drawn with the shaft center X of the drive shaft 4 being a center of the arc and passes through the rocking fulcrum position P1' at the maximum valve lift, and also is positioned an area inside an arc locus R1 which is drawn with a shaft center H that is a pivot of the pin 18 connecting the one end portion 15*a* of the rocker arm 15 and the nose end 16*b* of the link arm 16 being a center of the arc and passes through the rocking fulcrum position P1' at the maximum valve lift (a diagonally shaded area, which satisfies the above both areas).

Figure 6B:
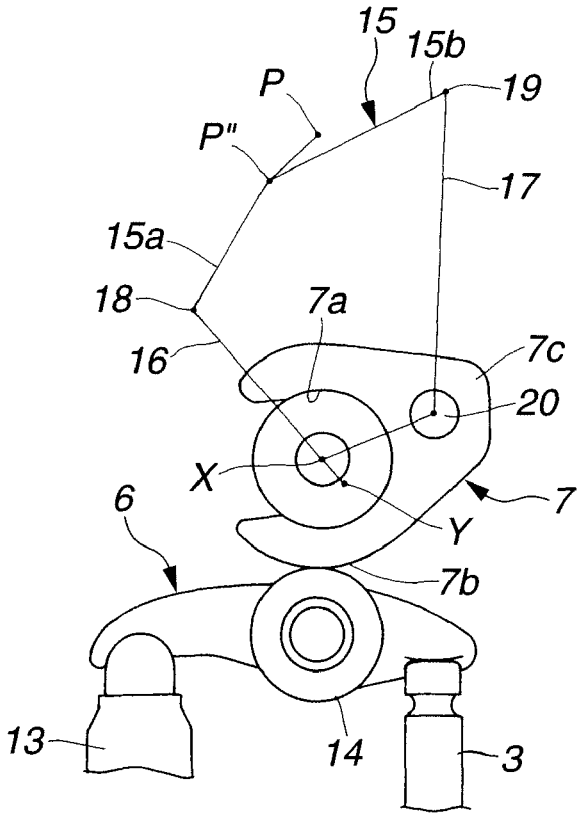

In the following, working or operation of this embodiment will be explained. First, for example, when the engine is in a low speed range such as an engine idle running state, the electric motor is driven and rotates by the control signal from the controller, and this rotation force or torque is transmitted to the control shaft 25 via the speed reducer, the control shaft 25 is then driven and rotates in one direction by a predetermined value. The control shaft 25 rotates the control cam 26 in the one direction, and the shaft center P1 of the control cam 26 rotates about the shaft center P of the journal part 25*b* with the same radius, then a thick portion moves away from the drive shaft 4 in the upward direction. By this movement, as shown in FIGS. 6A and 6B, the whole rocker arm 15 inclines in a left direction with respect to a perpendicular C that passes through the shaft center X of the drive shaft 4 and shaft center P of the journal part 25*b*, and an angle θ with the link arm 16 becomes large. With this motion, the each pin 19 that is a pivot of the each other end portion 15*b* of the rocker arm 15 and the each link rod 17 moves in the upward direction with respect to the drive shaft 4, thus the cam-nose portion 7*c* side of the each rockable cam 7 is forcibly pulled up or lifted up through the link rod 17.

Hence, when the drive cam 5 rotates and the one end portion 15*a* of the rocker arm 15 is pushed up through the link arm 16, as shown in FIGS. 6A and 6B, its valve lift amount is transmitted to the needle roller 14 of the swing arm 6 from the rockable cam 7 through the link rod 17, then its lift amount becomes sufficiently small.

Figure 8:
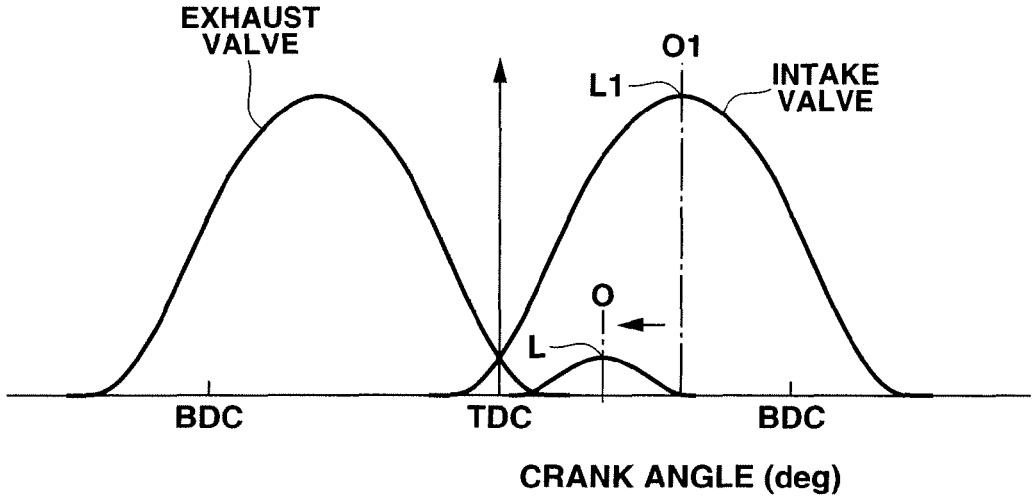
FIG. 8 is a valve lift characteristic of an exhaust valve and an intake valve.

Consequently, in the engine low-speed (low-revs) range, as illustrated in FIG. 8, a valve lift amount L of the intake valve 3 becomes sufficiently small, and also a valve open timing of the intake valve 3 is retarded, then no valve overlap with an exhaust valve exists. This results in an increase of the fuel efficiency and a stable engine operation due to reduction of a pump loss and improvement of the combustion.

Figure 7B:
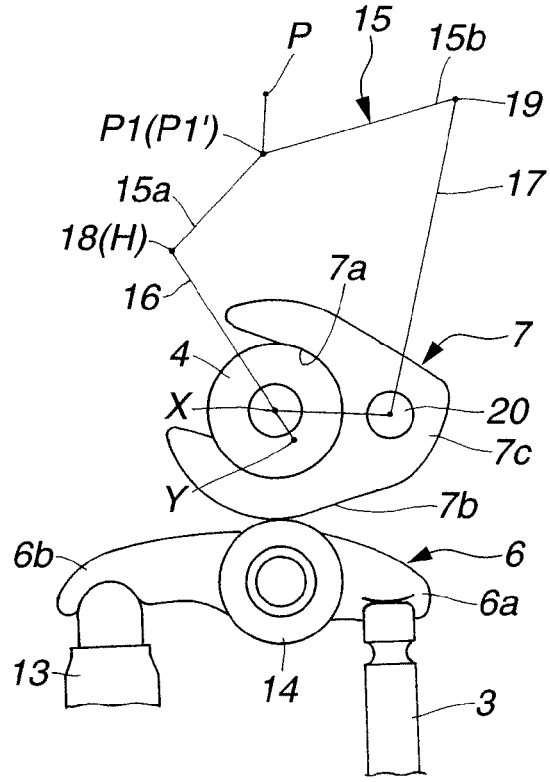

Next, for example, in a case where the engine running state shifts to an engine high speed (high-revs) range, when the electric motor rotates in a reverse direction by the control signal of the controller and rotates the speed reducer in the same direction, the control shaft 25 rotates the control cam 26 in the other direction by this rotation of the speed reducer. With this rotation of the control cam 26, the shaft center P1 of the control cam 26 is moved in a lower right direction (to a direction of the drive shaft 4), and is positioned on the perpendicular C. Thus, as illustrated in FIGS. 7A and 7B, this time, the whole rocker arm 15 inclines or oscillates (or rotates) in a right direction and moves to the direction of the perpendicular C, then the angle θ with the link arm 16 becomes small. Therefore, the cam-nose portion 7*c* of the rockable cam 7 is pushed down in a downward direction through the other end portion 15*b* of the rocker arm 15 and the link rod 17, and the whole rockable cam 7 rotates in the clockwise direction by a predetermined value.

Hence, the contact point (or contact surface) of the cam surface 7*b* of the rockable cam 7 with respect to the needle roller 14 of the swing arm 6 shifts to the cam-nose portion 7*c* side (to the lift surface side). Thus, when the drive cam 5 rotates and the one end portion 15*a* of the rocker arm 15 is pushed up through the link arm 16 at a time of the valve open operation of the intake valve 3, its lift amount with respect to the swing arm 6 becomes sufficiently large.

Consequently, in the engine high-speed (high-revs) range, as illustrated in FIG. 8, a valve lift amount L1 of the intake valve 3 becomes maximum, and also the valve open timing of the intake valve 3 is advanced, then the valve overlap with the exhaust valve becomes large, and a valve closure timing is retarded. As a consequence, an intake air charging efficiency is improved and a sufficient output can be ensured.

In this embodiment, as described above, since the shaft center P1" of the control cam 26 is set so that shaft center P1" is positioned within the area inside the diagonally shaded area shown in FIG. 7A at the time of the small valve lift control of the intake valve 3, it is possible to vary or shift a lift center angle phase (O) of the intake valve 3 to an advanced angle side, and the lift center angle phase (O) can be controlled to the advanced angle side as compared with a lift center angle phase (O1) at the maximum valve lift.

Here, in a case where the shaft center P1" of the control cam 26 is set on the arc locus R defining the diagonally shaded area, a phase variation or change of a valve open timing IVO of the intake valve becomes extremely small, same as the conventional variable valve system. On the other hand, in a case where the shaft center P1" is set on the arc locus R1, the lift center angle phase of the intake valve 3 remains unchanged.

In this embodiment, since the shaft center P1" of the control cam 26 is set within the area inside the diagonally shaded area, the phase of the valve open timing IVO can be controlled to a substantially same position as a top dead center (TDC) of a piston or to a slightly more retarded angle side than the TDC, as compared with the conventional variable valve system. Thus, the valve overlap with the exhaust valve during the small valve lift control of the intake valve 3 can be properly controlled, and this suppresses an increase of a residual gas and prevents a deterioration of combustion.

On the other hand, with regard to an intake valve closure timing IVC of the intake valve 3 at the time of the small valve lift control, its variation becomes large.

Figure 9:
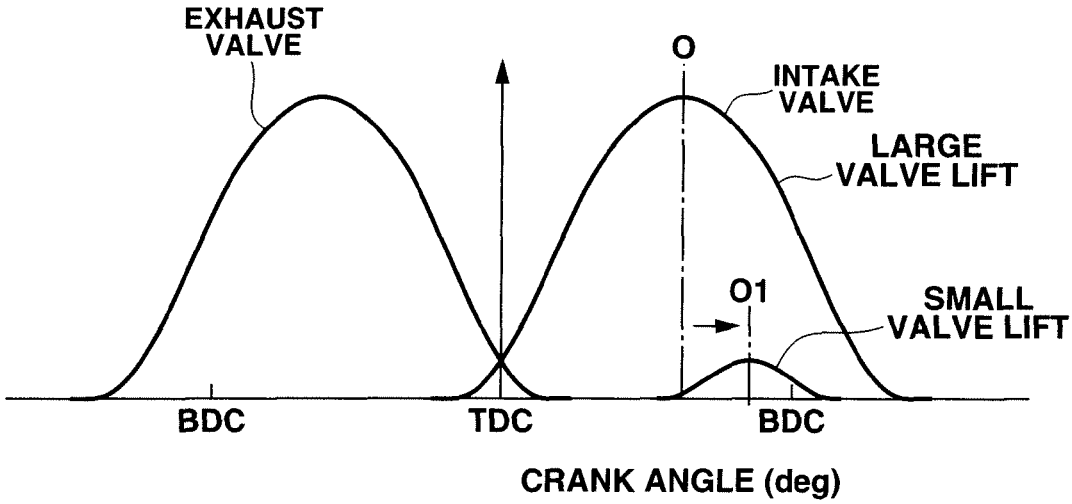
FIG. 9 is a valve lift characteristic of the intake valve in a case where a rocking direction of a rockable cam at a time of the valve open is opposite to a rotation direction of a drive shaft.

In addition, in this embodiment, although the each rockable cam 7 is set so that the rocking direction that opens the each intake valve 3 by the shift of the contact surface of the cam surface 7*b* to the lift surface side is the same as the rotation direction of the drive shaft 4, in a case where the rocking direction is set to be opposite to the rotation direction of the drive shaft 4, as illustrated in FIG. 9, a lift center angle phase (O1) of the intake valve 3 at the time of the small valve lift control can be controlled to the retarded angle side as compared with a center angle phase (O) at the maximum valve lift control. Further, the valve open timing IVO can be controlled to be sufficiently retarded, and also the valve closure timing IVC can be positioned close to a bottom dead center (BDC) of the piston or positioned on a slightly more retarded angle side than the BDC.

In the case of this embodiment, since the valve open timing IVO is sufficiently retarded by the small valve lift control during the engine low-speed and low-load operation, a negative pressure in the cylinder develops or becomes great. As a result, a sudden or rapid cylinder inflow of a mixture during the valve open of the intake valve 3 occurs, then an effect of the improvement of the fuel efficiency, such as atomization of the fuel, due to an increase of fuel inflow or inlet velocity, can be obtained. Moreover, since the valve closure timing IVC of the intake valve 3 is positioned close to the bottom dead center (BDC), an effective compression ratio becomes high, and this result in the good combustion.

Second Embodiment

Figure 10:
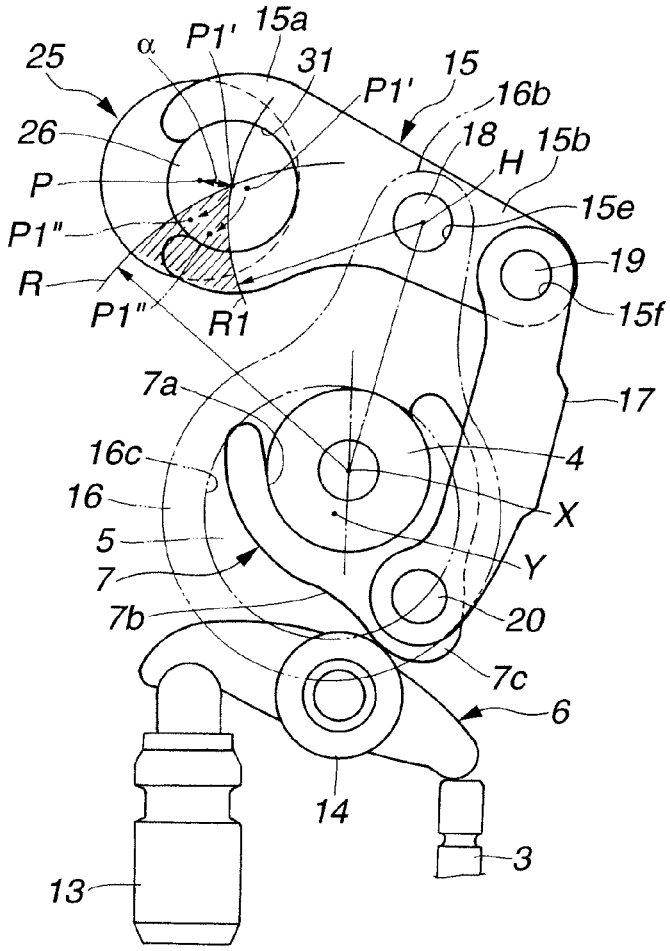
FIG. 10 is a schematic drawing of the variable valve system of a second embodiment.

FIG. 10 shows a second embodiment. In the second embodiment, a variable valve system has two rocker arms 15, 15 per cylinder and two link arms 16, 16 per cylinder, and a structure of the each rocker arm 15 is changed. Further, two control cams 26, 26 of the control shaft 25 are provided for the rocker arms 15, 15, and a structure of the each control cam 26 is also changed.

That is, the rocker arm 15 is bent or curved to a shape of angle bracket ("^"), and is provided with a substantially C-shaped fitting gulf or hole portion 31 at the one end portion 15*a* of the rocker arm 15 and also provided with an insertion hole 15*e* on the other end portion 15*b* side in a longitudinal direction of the rocker arm 15 and further a pin hole 15*f* at the other end portion 15*b*. The fitting hole portion 31 is rotatably fitted onto the control cam 26 and becomes the rocking fulcrum of the rocker arm 15. The pin 18 is inserted into the insertion hole 15*e* for linking the nose end 16*b* of the link arm 16 and the rocker arm 15. Furthermore, the pin 19 is inserted into the pin hole 15*f* for linking an upper end portion of the link rod 17 and the other end portion 15*b*.

Thus, this rocker arm 15 is set so that the one end portion 15*a* side fitting onto the control cam 26 is the rocking fulcrum of the rocker arm 15 and the whole of the other end side rocks or oscillates or swings in the upward and downward direction.

Figure 11:
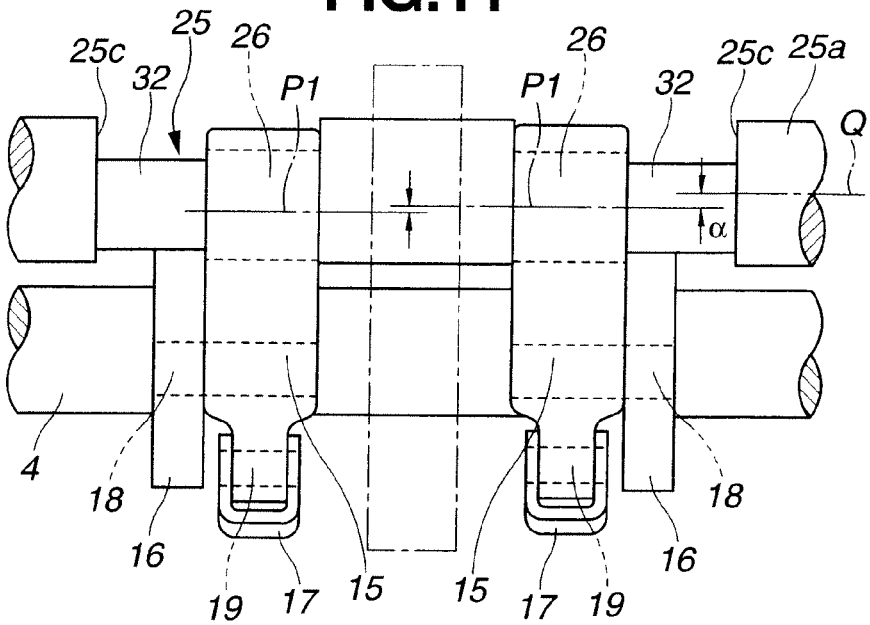
FIG. 11 is a plan view of the variable valve system.

Regarding the control shaft 25, as shown in FIG. 11, a substantially disk-shaped pair of stepped portions 25*c*, 25*c* are provided at opposite positions in a portion of the shaft body 25*a* where the rocker arm 15 is fitted, and the control cam 26 is integrally formed with the control shaft 25 between these stepped portions 25*c*, 25*c*.

With regard to the two control cams 26, 26 provided for the rocker arms 15, 15, they are set so that, as illustrated in FIGS. 10 and 11, two shaft centers P1, P1 of the control cams 26, 26 slightly deviates from each other, and an eccentric amount a of the shaft center P1 with respect to the shaft center Q of the shaft body 25*a* of the control shaft 25 becomes large.

Figure 12:
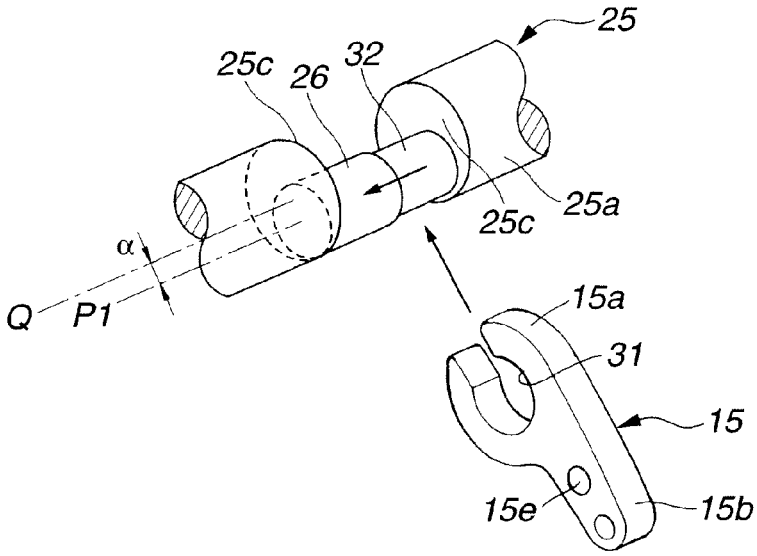
FIG. 12 is a perspective view showing the control shaft, the control cam and the rocker arm.

In addition, as shown in FIG. 12, a guide shaft portion 32 is integrally formed with a side portion in an axial direction of the control cam 26. This guide shaft portion 32 has a smaller diameter than the control cam 26, and when fitting the rocker arm 15 onto the control cam 26, first, the fitting hole portion 31 is fitted onto the guide shaft portion 32, then is guided to the control cam 26 side.

Then, in this embodiment, the rocking fulcrums P1, P1 of the rocker arms 15, 15 during the small valve lift amount control of the intake valves 3, 3 are set so that the rocking fulcrums P1, P1 are positioned in an area inside an arc locus R which is drawn with the shaft center X of the drive shaft 4 being a center of the arc and passes through the rocking fulcrum positions P1', P1' at the maximum valve lift, and also is positioned an area outside an arc locus R1 which is drawn with a shaft center (pivot) H of the pin 18 connecting the rocker arms 15, 15 and the link arms 16, 16 being a center of the arc and passes through the rocking fulcrum positions P1', P1' at the maximum valve lift (a diagonally shaded area, which satisfies the above both areas).

Furthermore, regarding the eccentric directions of the shaft centers P1, P1 of the control cams 26, 26, they are set so that their valve lift characteristics are the same at the time of the maximum valve lift of the intake valves 3, 3, while they are set so that a slight difference of the lift between the both lift characteristics appears during a minimum valve lift control.

Consequently, according to this embodiment, for instance, at the engine high-speed (high-revs) and high-load operation, the control shaft 25 is controlled and rotates in one direction by the actuator through the control signal from the controller, then the shaft center P1" of the each control cam 26 is held at the rotational position shown in FIG. 10. Thus, as shown in FIG. 14, the valve lift characteristics of the intake valves 3, 3 become maximum valve lift amounts L1, L1 which have almost no lift difference, same as the first embodiment.

Figure 13:
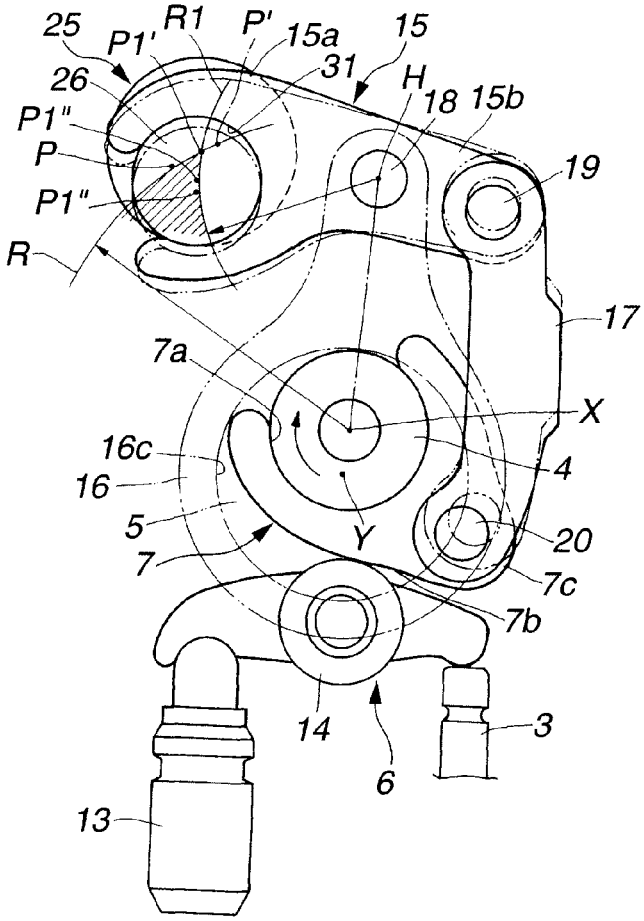
FIG. 13 is a drawing for explanation of working of the variable valve system.

On the other hand, for instance, when the engine running state shifts to the low-speed and low-load range, the control shaft 25 is controlled and rotates in the other direction by the actuator, and the shaft centers P1", P1" of the control cams 26, 26 are held at the rotational positions shown in FIG. 13. Thus, as shown in FIG. 14, the intake valves 3, 3 are controlled to small valve lift amounts L, L, and their center angle phases shift or are moved to the advanced angle side, same as the first embodiment.

Therefore, an optimum valve overlap with the exhaust valve can be obtained, same as the first embodiment, and this brings about the good combustion and improvement of the fuel efficiency and the stable engine operation.

Figure 14:
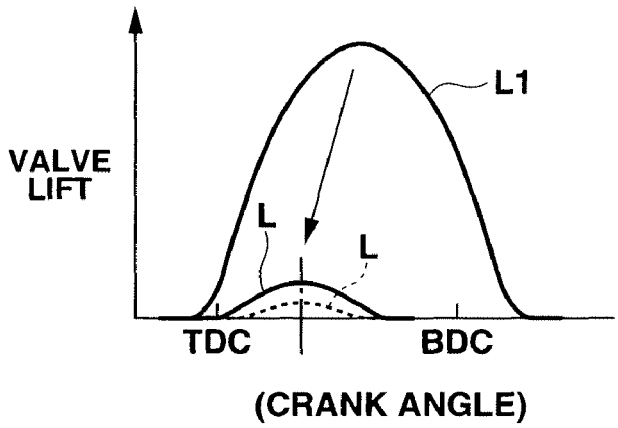
FIG. 14 is a valve lift characteristic of the variable valve system.

In addition, during this small valve lift control, as shown by a solid line and a broken line in FIG. 14, by the difference of the positions of the shaft centers P1", P1" of the control cams 26, 26, the slight difference is present in the valve lift amount of the intake valves 3, 3. Because of this, an intake or inlet swirl is generated inside the cylinder, and the combustion is further improved. This allows a further improvement of the fuel efficiency and the stable engine operation.

Third Embodiment

Figure 15:
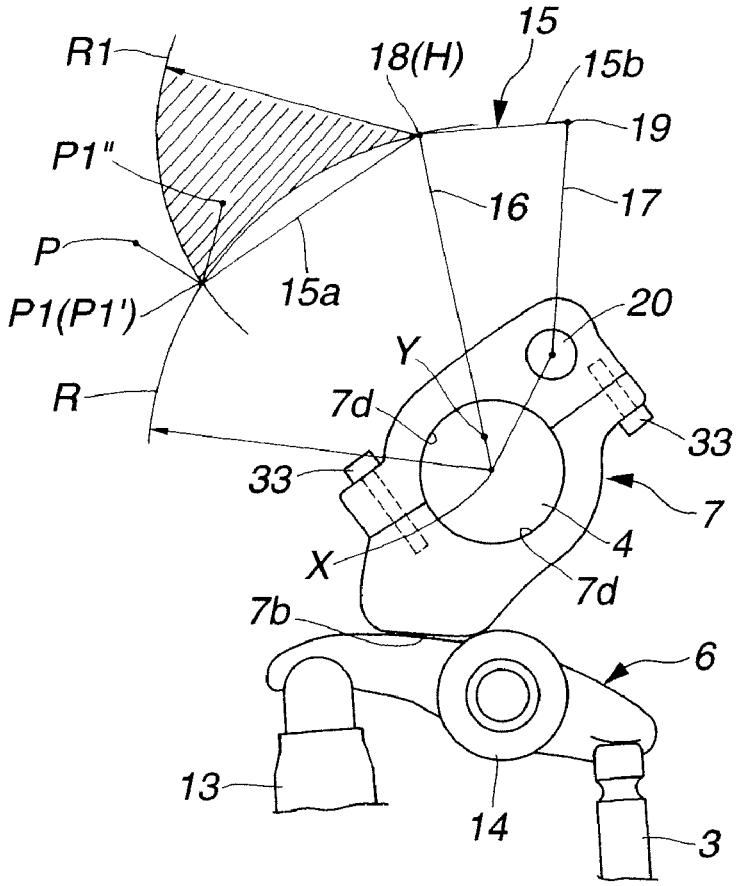
FIG. 15 is a schematic drawing of the variable valve system of a third embodiment.

FIG. 15 shows a third embodiment. In the third embodiment, structures of the rocker arm 15 etc. are the same as the second embodiment. However, the structure and direction of the each rockable cam 7 are different. That is, in this embodiment, the each intake valve 3 does not open by a push-down movement of the one end side of the rockable cam 7, but opens by a pull-up movement of the one end side of the rockable cam 7.

The rockable cam 7 has a two-piece members at upper and lower positions as can be seen in FIG. 15, and these upper and lower pieces are fixedly combined with each other with bolts 33, 33 at the respective end portions of the pieces. Further, the rockable cam 7 is provided with an opening or hole which is formed by both semicircle or arc hole portions 7*d*, 7*d* of the two-piece members. Then the rockable cam 7 is ratatably or rockably supported by the drive shaft 4 through the arc hole portions 7*d*, 7*d*.

Then, in this embodiment, the rocking fulcrum P1 of the rocker arm 15 during the small valve lift amount control of the each intake valve 3 is set so that the rocking fulcrum P1 is positioned in an area outside an arc locus R which is drawn with the shaft center X of the drive shaft 4 being a center of the arc and passes through the rocking fulcrum position P1' at the maximum valve lift, and also is positioned an area inside an arc locus R1 which is drawn with a shaft center (pivot) H of the pin 18 connecting the rocker arm 15 and the link arm 16 being a center of the arc and passes through the rocking fulcrum position P1' at the maximum valve lift (a diagonally shaded area, which satisfies the above both areas).

Here, unlike the second embodiment, in this embodiment, the lift difference during the small valve lift amount control of the intake valves 3, 3 is not set.

Accordingly, also in this embodiment, under the small valve lift amount control, in the case where the rocking direction of the rockable cam 7, which opens the valve, and the rotation direction of the drive shaft 4 are the same, the phase of the valve open timing IVO of the each intake valve 3 is controlled to an optimum advanced angle side position, and the optimum valve overlap with the exhaust valve can be obtained.

Fourth Embodiment

Figure 16:
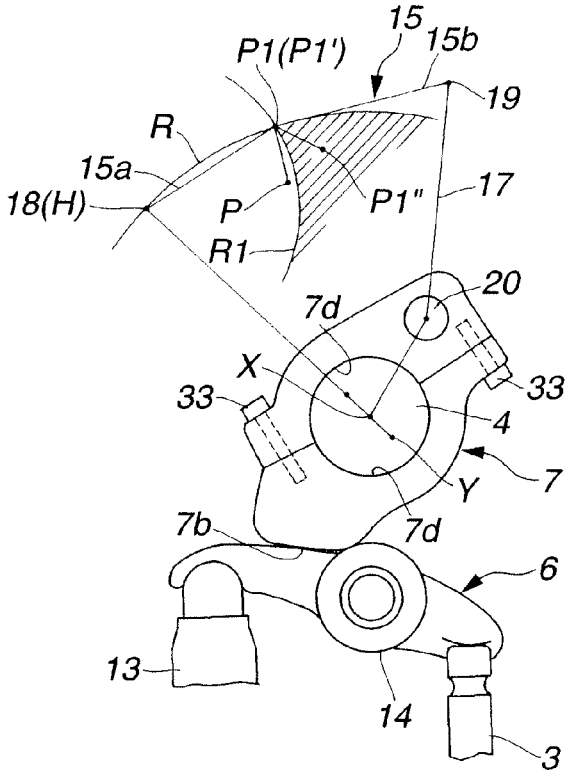
FIG. 16 is a schematic drawing of the variable valve system of a fourth embodiment.

FIG. 16 shows a fourth embodiment. The structure of the rocker arm 15 is the same as that of the first embodiment, and the structure of the rockable cam 7 is the same as that of the third embodiment. In this embodiment, same as the third embodiment, the each intake valve 3 does not open by a push-down movement of the one end side of the rockable cam 7, but opens by a pull-up movement of the one end side of the rockable cam 7.

In this embodiment, as shown in FIG. 16, the rocking fulcrum P1 of the rocker arm 15 during the small valve lift amount control of the each intake valve 3 is set so that the rocking fulcrum P1 is positioned in an area inside an arc locus R which is drawn with the shaft center X of the drive shaft 4 being a center of the arc and passes through the rocking fulcrum position P1' at the maximum valve lift, and also is positioned an area outside an arc locus R1 which is drawn with a shaft center (pivot) H of the pin 18 connecting the one end portion 15*a* of the rocker arm 15 and the link arm 16 being a center of the arc and passes through the rocking fulcrum position P1' at the maximum valve lift (a diagonally shaded area, which satisfies the above both areas).

Accordingly, also in this embodiment, the same effects as the first embodiment can be obtained.

Figure 17:
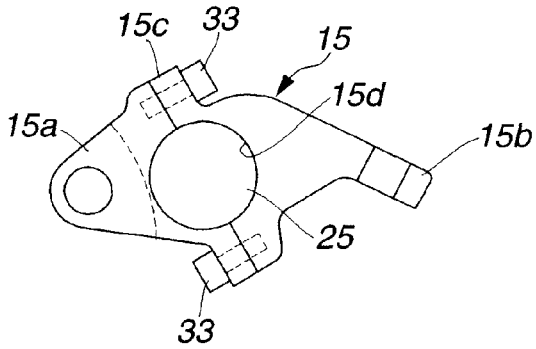
FIG. 17 is a side view of another rocker arm.
Figure 18:
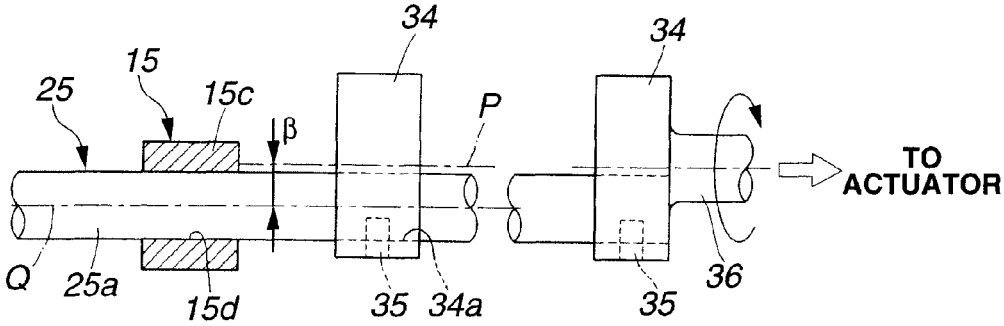
FIG. 18 is a side view of an essential part of the control shaft that supports the rocker arm and a journal part.

Here, in FIGS. 17 and 18, another embodiment, which makes a modification to the structure of the rocker arm 15 and is able to set the eccentric amount of the control shaft 25 to be large, is shown.

That is, the rocker arm 15 has a two-piece members on the one end portion 15*a* side and the other end portion 15*b* side, which is divided at the cylindrical base part 15*c*. These two members are fixedly combined with each other with a pair of bolts 33, 33 when fitting the rocker arm 15 onto the control cam 26.

On the other hand, with respect to the control shaft 25, a journal part 34 that is supported by the bearing portion 12 is fixed to a certain position in the axial direction of the shaft body 25*a*. More specifically, this journal part 34 is formed into a cylindrical shape, and is formed as a different member from the shaft body 25*a* (the control shaft 25). The journal part 34 is provided with an insertion hole 34*a* at an eccentric position thereof, into which the shaft body 25*a* is inserted, and is fixedly connected with the shaft body 25*a* with a rotation stopper pin 35. With this structure, an eccentric amount β of a shaft center P of the journal part 34 with respect to the shaft center Q of the shaft body 25*a* of the control shaft 25 can be arbitrarily set to be large.

Further, as shown in FIG. 18, the journal part 34 fixed at one end portion side of the control shaft 25 has a connecting shaft 36. The connecting shaft 36 is connected with the middle on an outer side surface of the journal part 34, and linked to the actuator (not shown).

When installing the control shaft 25 to the bearing portion 12, first, the rocker arm 15 and the journal part 34 are previously inserted onto the shaft body 25*a*, and the each journal part 34 is fixed to the certain position of the shaft body 25*a* with the rotation stopper pin 35. Next, the each journal part 34 is installed to the corresponding bearing portion 12 to be supported.

With this setting, the installation of the rocker arm 15 to the control shaft 25 can be done without dividing the rocker arm 15, then the compact rocker arm is realized and also rigidity of the rocker arm 15 is increased.

In this embodiment, when the each journal part 34 is controlled and rotates within a predetermined angular range by the actuator through the connecting shaft 36, the control shaft 25 is eccentrically revolves around the journal part 34 (the shaft center P) with a large eccentric amount β within a predetermined angle. Thus, since the rocking fulcrum Q of the control shaft 25 varies large or widely, the variation of the valve lift amount of the each intake valve 3 can be set to be large.

Fifth Embodiment

Figure 19:
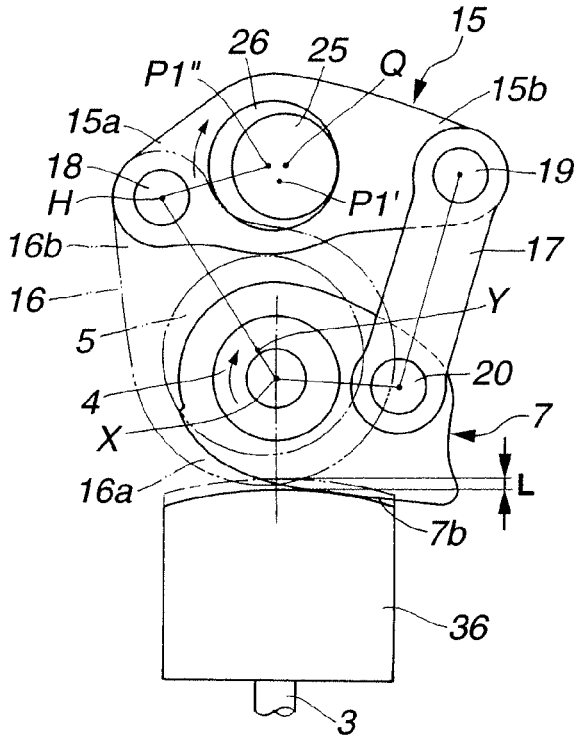
FIG. 19 is a sectional view of an essential part of the variable valve system of a fifth embodiment.
Figure 20:
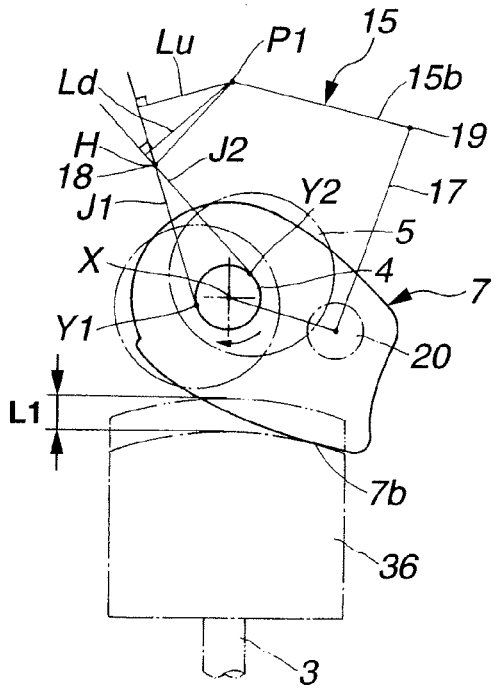
FIG. 20 is a schematic drawing of the variable valve system.

FIGS. 19 and 20 show a fifth embodiment. In this embodiment, with regard to the valve lift characteristic of the each intake valve 3 whose open/close movement is operated by the each rockable cam 7, a lift-rising side and a lift-falling side are set to be asymmetrical.

A basic structure of this variable valve system is the same as the system disclosed in Japanese Patent Provisional Publication No. 11-107725 which was previously applied by the same applicants of this application. Therefore the detailed explanation about the structure is omitted here. In this embodiment, the each rockable cam 7 operates the open/close movement of the each intake valve 3 via each valve lifter 36 instead of the swing arm 6, and the rocking direction of the rockable cam 7 which opens the intake valve 3 and the rotation direction of the drive shaft 4 are set to the same direction.

Further, in this embodiment, as shown in FIG. 20, connecting lines J1, J2 and perpendiculars Lu, Ld are defined as follow;

the connecting lines J1, J2 are the lines that connect the shaft center Y (Y1, Y2) of the drive cam 5 fixed to the drive shaft 4 and the shaft center H of the pin 18 linking the one end portion 15*a* of the rocker arm 15 and the nose end 16*b* of the link arm 16, and the perpendiculars Lu, Ld are the perpendiculars that are drawn from the shaft center P1 of the control cam 26, which is the rocking fulcrum of the rocker arm 15, to the connecting lines J1, J2. Then, distances (lengths) of the perpendiculars Lu, Ld are set to be different from each other on the lift-rising and lift-falling sides.

That is, as illustrated in FIGS. 19 and 20, under the maximum valve lift control of the intake valve 3, the length of the perpendicular Lu drawn from the shaft center P1 of the control cam 26 to the connecting line J1 connecting the shaft center Y1 of the drive cam 5 and the shaft center H of the pin 18 at the time of the lift-rising is set to be smaller (shorter) than the length of the perpendicular Ld drawn from the shaft center P1 of the control cam 26 to the connecting line J2 connecting the shaft center Y2 of the drive cam 5 and the shaft center H of the pin 18 at the time of the lift-falling.

Figure 21:
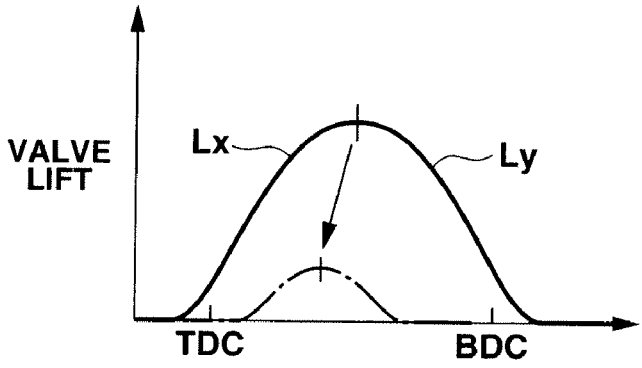
FIG. 21 is a valve lift characteristic of the variable valve system.

With this linkage, the valve lift characteristic of the intake valve 3 has a characteristic shown in FIG. 21. That is, a lift-rising side Lx is a relatively steep curve and a lift-falling side Ly is a relatively gentle curve. This characteristic appears also under the small valve lift control as shown by a chain line in FIG. 21.

The other mechanism and linkage are the same as the first embodiment. Since the small valve lift control of the intake valve 3 is performed by rotating the control cam 26 in the clockwise direction and the rocking fulcrum P1 of the rocker arm 15 rocks or swings (or moves) toward an upper area of the drive shaft 4, the center angle phase of the valve lift shifts to the advanced angle side.

Consequently, according to this embodiment, the variation of the valve open timing of the intake valve 3 can be small by the steep curve at the lift-rising, and the variation of the valve closure timing can be large by the gentle curve at the lift-falling. As a consequence, the variation of the valve open timing during the small valve lift control of the intake valve 3 can be small, and the variation of the valve closure timing can be large, same as the first embodiment. This embodiment has these effects, then the further optimum control of the valve overlap with the exhaust valve can be achieved.

Here, in this mechanism and linkage, since the valve lift characteristic is asymmetrical, a control quantity of the rocking fulcrum (or center) position of the rocker arm 15 can be reduced, then a drive load of the actuator can be reduced.

Sixth Embodiment

Figure 22:
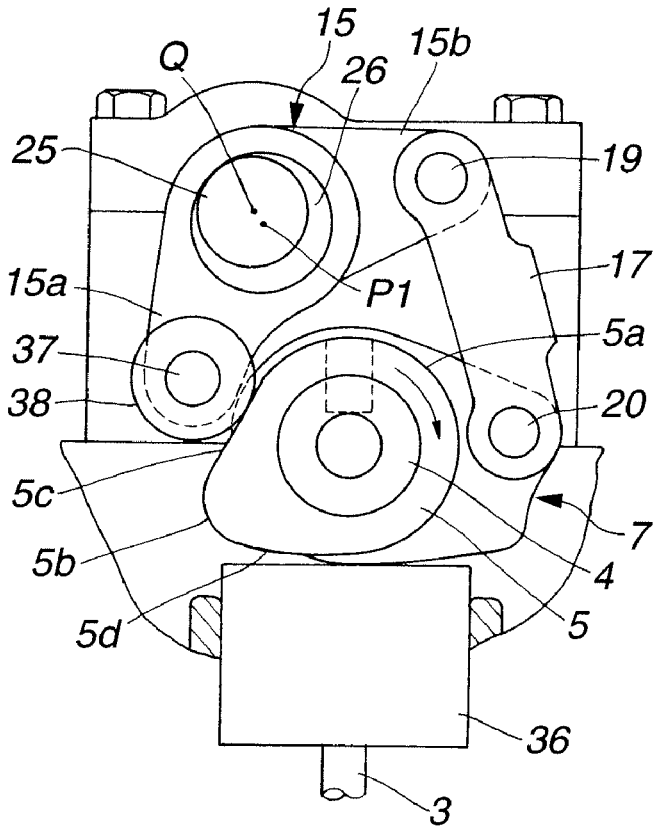
FIG. 22 is a sectional view of an essential part of the variable valve system of a sixth embodiment.

FIG. 22 shows a sixth embodiment. This is the other embodiment in which the valve lift characteristic of the intake valve 3 is set to be asymmetrical on the lift-rising and lift-falling sides. Basic structures of the rockable cam 7 etc. are similar to the fifth embodiment. However, an outer peripheral shape of the drive cam 5 is not circular, but is formed into a normal oval shape. Furthermore, a roller 38 is provided at the one end portion 15*a* of the rocker arm 15 through a supporting shaft 37, and the roller 38 (an outer peripheral surface of the roller 38) rolls on the outer peripheral surface of the drive cam 5, then the rotation force or torque of the drive cam 5 is transmitted to the rocker arm 15 via the roller 38. The roller 38 is set so that the roller 38 is constantly pushed or pressed against the outer peripheral surface of the drive cam 5 by a spring force of a forcing member such as a torsion spring.

Further, the control cam 26 is fixed on an outer periphery or circumference of the control shaft 25. The center of the control cam 26 deviates from the center of the control shaft 25, and the center of the control cam 26 is the shaft center P1 of the rocking fulcrum of the rocker arm 15.

A cam profile of the drive cam 5 is formed by a base-circle surface 5*a* on the drive shaft 4, a lift surface 5*b* on opposite side to the base-circle surface 5*a*, a lift-rising surface 5*c* that is positioned on a front side of the rotation direction between the base-circle surface 5*a* and the lift surface 5*b*, and a lift-falling surface 5*d* that is positioned on a back side of the rotation direction.

More specifically, the lift-rising surface 5*c* and the lift-falling surface 5*d* have asymmetrical shapes, and an inclination angle of the lift-rising surface 5*c* is set to be greater than an inclination angle of the lift-falling surface 5*d* to obtain the relatively steep rising and gentle falling characteristic.

The other mechanism and linkage of this embodiment are the same as the first embodiment.

Consequently, according to this embodiment, same as the fifth embodiment, the variation of the valve open timing of the intake valve 3 can be small by the steep angle at the lift-rising, and the variation of the valve closure timing can be large by the gentle angle at the lift-falling. As a consequence, the variation of the valve open timing during the small valve lift control of the intake valve 3 can be small, and the variation of the valve closure timing can be large, same as the first embodiment. This embodiment has these effects, then the further optimum control of the valve overlap with the exhaust valve can be achieved.

The present invention is not limited to the above explained embodiments. For instance, depending on the spec or size of the system, the position of the shaft center P1" of the control cam 26 during the small valve lift control can be further changed. Furthermore, the present invention can be applied to the exhaust valve, or both of the intake and exhaust valves.

This application is based on a prior Japanese Patent Application No. 2007-294374 filed on Nov. 13, 2007. The entire contents of this Japanese Patent Application No. 2007-294374 are hereby incorporated by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. A variable valve system of an internal combustion engine, comprising:

a drive shaft which has a drive cam on an outer periphery thereof and to which a power is transmitted from an engine crankshaft;

a rockable cam which is rockably supported and opens/closes an engine valve;

a transmission mechanism, one end side of which is rotatably linked to the drive cam through a pivot and the other end side of which is linked to the rockable cam, the transmission mechanism converting a torque of the drive cam into a rocking motion and transmitting the rocking motion to the rockable cam;

a control shaft, a rotation of which is controlled by an actuator; and a control cam which is fixed on an outer periphery of the control shaft and is a rocking fulcrum of the transmission mechanism, a shaft center of the control cam deviating from a shaft center of the control shaft, and the variable valve system varying a valve lift amount of the engine valve by changing the rocking fulcrum of the transmission mechanism through a rotation control of the control cam via the control shaft, and the rocking fulcrum of the transmission mechanism during a small valve lift control of the engine valve being positioned in an area outside an arc locus which is drawn with the drive shaft being a center of the arc and passes through a rocking fulcrum position positioned at a time of a maximum valve lift and also inside an arc locus which is drawn with a pivot of the one end side of the transmission mechanism being a center of the arc and passes through the rocking fulcrum position positioned at the time of the maximum valve lift.

2. The variable valve system of the internal combustion engine as claimed in claim 1, wherein:

a rocking direction of the rockable cam, which opens the engine valve through the transmission mechanism, is set to a same direction as a rotation direction of the drive shaft.

3. The variable valve system of the internal combustion engine as claimed in claim 1, wherein:

a rocking direction of the rockable cam, which opens the engine valve through the transmission mechanism, is set to an opposite direction to a rotation direction of the drive shaft.

4. The variable valve system of the internal combustion engine as claimed in claim 1, wherein:

a valve lift characteristic of the engine valve that is opened/closed by the rockable cam is set to be asymmetrical on lift-rising and lift-falling sides.

5. The variable valve system of the internal combustion engine as claimed in claim 1, wherein;

the control shaft has a journal part on a predetermined position in an axial direction thereof, and a shaft center of the journal part deviates from the shaft center of the control shaft.

6. The variable valve system of the internal combustion engine as claimed in claim 4, wherein:

the valve lift characteristic on the lift-rising side is set to be steeper than the valve lift characteristic on the lift-falling side, and a rocking direction of the rockable cam, which opens the engine valve through the transmission mechanism, is set to a same direction as a rotation direction of the drive shaft.

7. The variable valve system of the internal combustion engine as claimed in claim 5, wherein:

an eccentric direction of the shaft center of the journal part is set to be 180 degrees opposite to an eccentric direction of the control cam with respect to the shaft center of the control shaft.

* * * * *